US006126465A

United States Patent [19]

Franks, Jr.

[11] Patent Number: 6,126,465

[45] Date of Patent: Oct. 3, 2000

[54] ELECTRICAL CONNECTOR SYSTEM HAVING DUAL PURPOSE JACK

[76] Inventor: George J. Franks, Jr., 664 Thompson Cir., Inverness, Ill. 60067

[21] Appl. No.: 09/237,077

[22] Filed: Jan. 25, 1999

[51] Int. Cl.[7] ..... H01R 27/00

[52] U.S. Cl. ..... 439/218; 439/669

[58] Field of Search ..... 439/218, 668, 439/669

[56] References Cited

U.S. PATENT DOCUMENTS

| | | | |
|---|---|---|---|
| 1,646,541 | 10/1927 | Kaisling | 439/218 |
| 4,245,875 | 1/1981 | Shaffer | 439/218 |
| 4,873,479 | 10/1989 | Iimura et al. | 320/2 |
| 5,096,441 | 3/1992 | Jaag | 439/218 |
| 5,244,402 | 9/1993 | Pasterchick, Jr. et al. | 439/218 |
| 5,669,779 | 9/1997 | Galloway | 439/188 |
| 5,797,768 | 8/1998 | Francaviglia . | |
| 5,928,020 | 7/1999 | Bishop, Jr. et al. | 439/218 |

OTHER PUBLICATIONS

Senior Industries audio plug SI–341 drawing, Dec. 18, 1997.

Senior Industries audio jack part SI–540 drawing, Mar. 27, 1997.

Senior Industries power jack M–525 drawing, Mar. 1, 1996.

Senoir Industries power plug part SI–505 drawing, Mar. 22, 1993.

*Primary Examiner*—Brian Sircus

*Assistant Examiner*—J. F. Duverne

*Attorney, Agent, or Firm*—Ronald L. Wanke; Jenner & Block

[57] ABSTRACT

A dual purpose jack (20) connectable to a printed circuit board is capable of accepting an audio plug and a power plug. The audio plug (50) has a projecting pin containing a series of spaced annular external contacts connectable to an audio signal. The projecting pin includes a hollow insulated sleeve which mates with a metal pin (120) of the jack to insulate the audio plug from the power portion of the jack. The power plug (40) includes a projecting pin (42) which is hollow and mates with the metal pin (120) of the jack to form the power contact. The combination jack has various leaf springs which move into engagement with the projecting pins of the two plugs and which are aligned in different planes in order to assist in miniaturization of the jack.

4 Claims, 5 Drawing Sheets

ELECTRICAL CONNECTOR SYSTEM HAVING DUAL PURPOSE JACK

This invention relates to an electrical connector system having a dual-purpose jack capable of accepting multiple types of plugs for cables with varying numbers of conductors, such as plugs for power and audio signals. The invention is particularly useful for a miniature jack capable of accepting either a power plug or an audio plug.

BACKGROUND OF THE INVENTION

Electrical connectors, such as power jacks and audio or data signal jacks, are typically mounted on printed circuit boards for use in a variety of electronic equipment. For example, a separate jack is typically provided for a power connection to recharge a battery and another jack for an audio connection used in a cellular telephone after the battery is recharged. Typically, only one jack may be utilized at a time for its associated purpose. The power plug and the audio plug have special shapes to prevent the connectors from accidental insertion into the wrong connector, for example, to prevent accidental insertion of a power jack into an audio receiving plug (or vice versa) which could cause damage to the electronic equipment. The power connection is often used to provide low voltage DC from an external power supply to the printed circuit board for charging internal batteries, and the audio jack is typically used to allow the user to connect headphones to the cellular telephone.

It is desirable to minimize the amount of circuit board area required for such connectors, particularly in small, lightweight, portable devices. It is also desirable to eliminate the need for multiple types of connectors, reducing the parts list and inventory for a product and thereby resulting in cost savings and assembly efficiencies.

As portable devices become ultra-miniaturized, there is insufficient space for the series of separate jacks and plugs which are connectable to the device. Furthermore, it becomes difficult for the user to determine which plug should go within which jack and the user may attempt to force a connection which is improper and which can damage the equipment.

SUMMARY OF THE INVENTION

In accordance with the present invention, an electrical connector system is provided which includes a dual purpose jack capable of accepting multiple different types of plugs, including plugs designed for cables with varying numbers of conductors.

An object of the invention is to provide a single type of combination jack which can be used for different purposes, such as for power input as well as audio signals. A further object is to provide a combination jack which can receive plugs for different number of conductors. A related object is to provide multiple types of plugs for different number of conductors which can be used with a single type of receptor jack.

A further object is to provide a connector system which can accommodate both power and audio signals without damage to the electronic equipment.

DETAILED DESCRIPTION OF THE INVENTION

Figure 1:
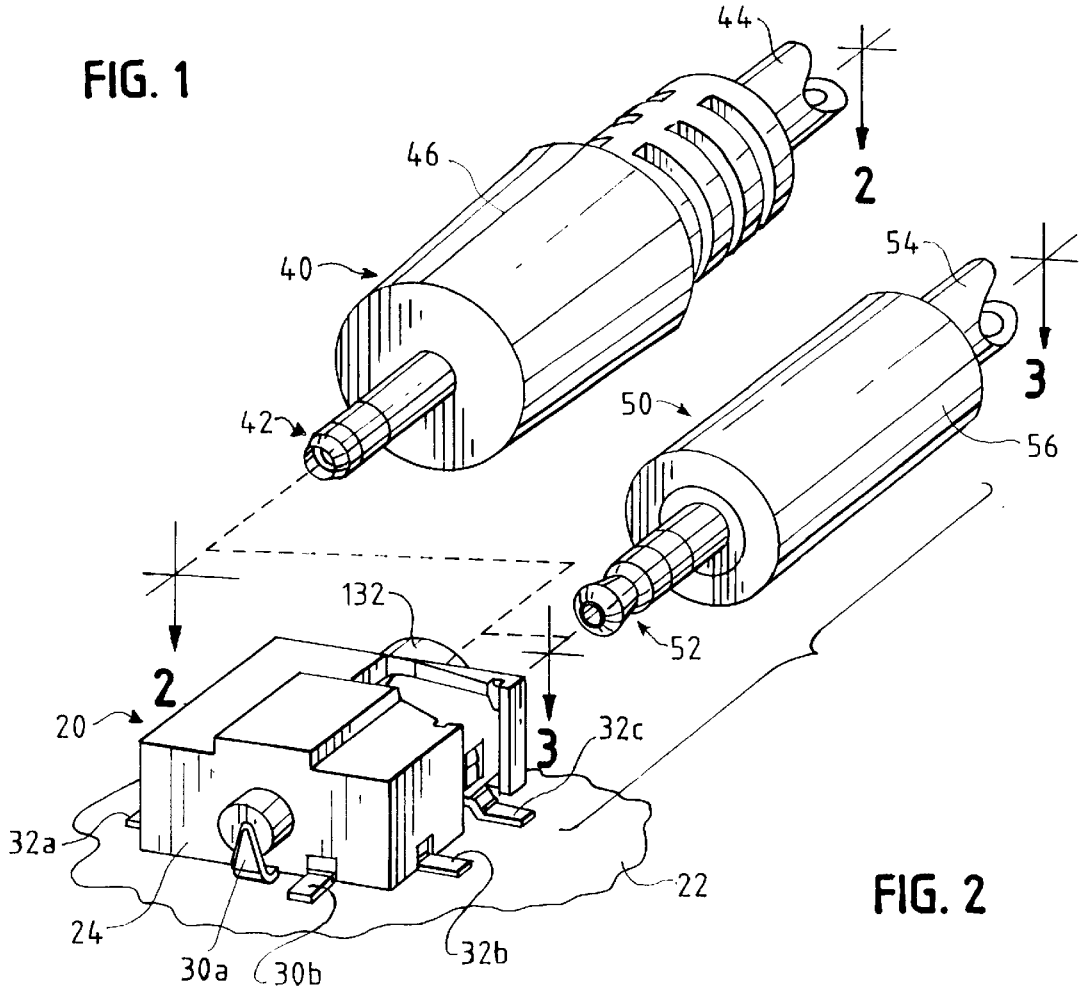
FIG. 1 is a perspective view of the electrical connector system according to the present invention, showing the dual-purpose jack and two types of plugs, illustrated as power and audio, for insertion into the single jack.

As shown in FIG. 1, an electrical jack 20 is designed to be surface mounted on a printed circuit board 22. Jack 20 includes a housing 24 which is preferably made of a non-conductive material such as plastic. A plurality of electrical terminals extend outwardly from the housing 24 for connection by soldering to pads on the printed circuit board 22. In particular, a pair of electrical terminals 30*a*, 30*b* extending to the rear of the housing provide a surface mount for a power connection to the printed circuit board 22. Three electrical terminals 32*a*, 32*b* and 32*c* extending from the sides of the housing serve as signal surface mount terminals for signals to the printed circuit board 22. By way of example, these will be described as audio signals, but the invention is equally useable for data or other signals distinct from the power connection. Thus, the single jack 20 serves a combination purpose and serves as the electrical receptor for separate power and audio input to the printed circuit board. The surface mount is illustrated by way of example only, and the connectors 30*a*, 30*b* and 32*a*, 32*b*, 32*c* can be in the form of wires which extend straight down from the housing 4 for insertion into apertures in the printed circuit board.

As also seen in FIG. 1, a power plug 40 is designed for mating with the jack receptacle 20. A projecting male pin 42, which is hollow, provides a two connector surface which, when inserted within the jack 20, will couple power to and from a two conductor power cable 44 to the power terminals 30*a*, 30*b*. A removable cap 46 serves as a cover and protection for the plug 40 and provides a convenient grip when inserting or removing the plug 40 into the jack 20.

Alternatively, an audio plug 50 is also designed for mating engagement with the jack 20. The audio jack has a projecting male pin 52, also partially hollow, which extends into the receptacle of jack 20 in order to provide three audio connections from an audio cable 54 having three conductors to the jack. A removable cap 56 is provided to cover and protect the audio plug 50 and provide a convenient grip when inserting or removing the plug.

The power plug 40 is similar overall to standard power plugs, but has been modified to accommodate its use with a single combination jack 20. When plug 40 is inserted into the jack 20, power in the form of a DC voltage such as 12 V. or the like from the cable 44 is coupled to the power terminals 30*a,* 30*b* and hence to the printed circuit board 22 for purposes such as recharging a battery of a cellular telephone. Typically, this recharging operation is accomplished separate from any operational use of the device during recharging. After recharging, the power jack 40 is removed from the combination jack 20. Then, the audio plug 50 is inserted into the same combination jack 20 in order to couple the audio signals from cable 54 to the audio terminals 32*a,* 32*b* and 32*c* of the combination jack 20. The audio jack 50 is similar overall to standard shapes for audio jacks, but has been modified so as to accommodate the special function of being utilized with a single combination jack 20 on the printed circuit board.

More particularly, when the power plug 40 is inserted into the jack 20, the audio terminals 32*a,* 32*b* and 32*c* are effectively isolated because the internal contacts are in engagement with insulated portions of the power jack 40. Likewise, when the audio plug 50 is inserted into the jack 20, the power terminals 30*a,* 30*b* are isolated from the audio circuit because internal contacts engage certain insulated portions of the pin 52 of the audio jack 50. As a result, the single jack 20 can serve the dual and combination purpose of providing a common, shared input for a two-conductor jack having one set of purposes and a different three or more conductor jack serving a different set of purposes, while isolating the signals so that only the proper signals flow to the respective terminals associated with the desired function.

Another advantage of the combination jack is that the user does not have to determine which plug to insert into a series of jacks on electronic equipment. As this equipment becomes ultra-miniaturized, with jacks having pin diameters for pins 42 and 52 such as 3.5 mm or 2.5 mm, it is difficult to visually determine the shape of the plugs and which jack should receive the plug. The combination jack accepts a plurality of different shaped plugs and avoids a user forcing plugs into jacks which do not accommodate that plug.

Figure 2:
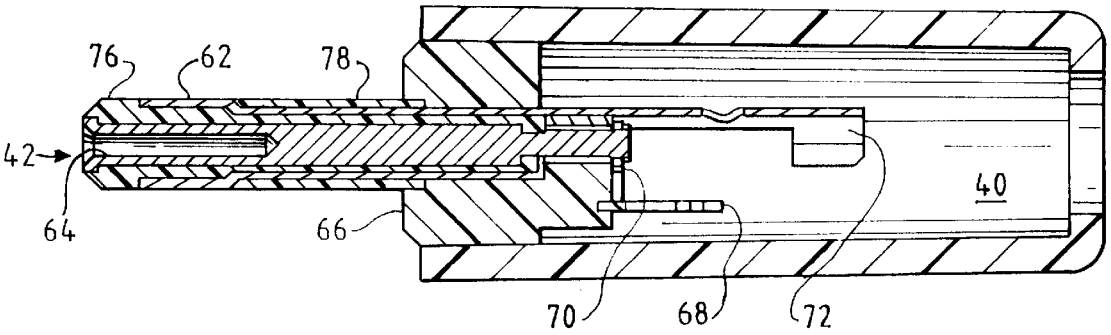
FIG. 2 is a cross-sectional view taken along lines 2—2 of FIG. 1 showing in section a two-conductor power plug for use with the dual-purpose jack of FIG. 1.

FIG.2 is a cross-sectional view of the power plug 40 of FIG. 1 including the unique pin 42 which projects outwardly and mates with the jack 20. The projecting pin 22 is seen in enlarged detail in FIGS. 8–10 as inserted into the jack 20, and reference should be made to these additional drawings for clarity. In particular, pin 42 includes a metal tubular outer sleeve 62 and a partly hollow metal inner tube 64 which serve as the two electrical contacts for power. The inner tube 64 is hollow at its terminus and solid at its rear where it extends through an insulated base 66 to an extending pin terminal 68 to which one of the power conductors (not illustrated) of the cable 44 can be soldered. Staking 70 is provided to mechanically and electrically hold the inner tubular shaft 64 to the pin terminal 68. The outer metal sleeve 62 extends rearwardly with reduced diameter through the insulating base 66 (see FIG. 8) and extends to a sleeve terminal 72 to which a second power conductor (not illustrated) of the cable 44 can be attached. A first insulating tube 76 serves to separate and insulate the metal inner shaft 64 from the metal outer sleeve 62 and creates an annular exterior ring on the pin 42 which is insulated. Spaced longitudinally behind the exterior ring of metal outer sleeve 62 is a second insulated tube 78 which serves to insulate the rear portion of the metal terminal 62 (which will isolate the power pin 60 from the audio terminals inside the jack, as will be explained later).

In summary, pin 42 of power plug 40 is designed for insertion into the jack 20 in such a manner that the external metal sleeve 62 and the internal annular surface 64, which creates a pin receptacle, will make electrical connection with corresponding electrical contacts inside the jack 20 which connect to the power terminals 30*a* and 30*b*. The pin 42 has a longitudinal extent of alternating bands of insulators and conductors along its exterior. When pin 42 is located inside of the jack 20, the various insulators including 76 and 78 will make contact with certain audio contacts inside the jack 20 and hence will isolate and electrically disconnect the audio terminals 32*a,* 32*b* and 32*c* from any effective functioning while the power plug 40 is inserted inside the combination jack 20.

Figure 3:
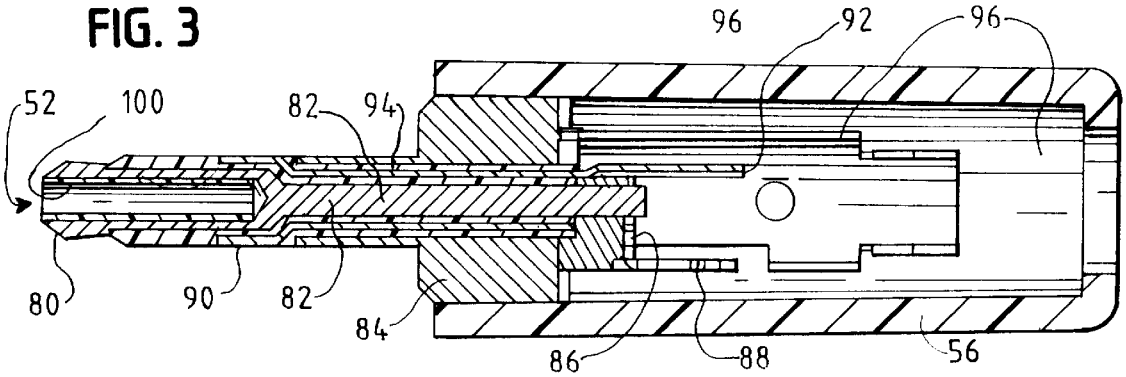
FIG. 3 is a cross-sectional view taken along lines 3—3 of FIG. 1 showing in section a three-conductor audio plug for use with the dual-purpose jack of FIG. 1.

FIG. 3 is a cross-sectional view of the audio plug 50 seen in FIG. 1. The elongated pin 52 is seen in more detail in expanded views in FIGS. 5–7, which illustrate the audio plug when inserted fully into the jack 20, and reference should be made to these views for additional details. The longitudinal exterior extent of pin 52 creates three bands of conductive areas which are each generally tubular in shape and can be best understood with reference to FIGS. 5 and 7. A first metal tip 80 consists of a hollow outer tip which extends rearwardly to a solid metal shaft 82 which extends through a base 84. The metal tube 82 is staked at 86 (see FIG. 3) to a tip terminal 88 located within the removable cover cap 56 for connection to one of three audio connectors (not illustrated) for the audio cable 54.

Spaced inwardly from the tip 80 is a second metal sleeve 90 which creates a ring conductive band on the exterior of the pin 52 for contact with a spring member (to be described later) in the jack. The metal sleeve 90 extends rearwardly with a reduced diameter neck spaced from the metal tube 82 and extending rearwardly through base 84 to a ring terminal 92 located inside the removable cover 56. Spaced behind the ring sleeve 90 is a third metal sleeve 94 of tubular shape which extends rearwardly to a metal base 84 which is staked to a sleeve terminal 96 located at the rear of the plug.

Figure 5:
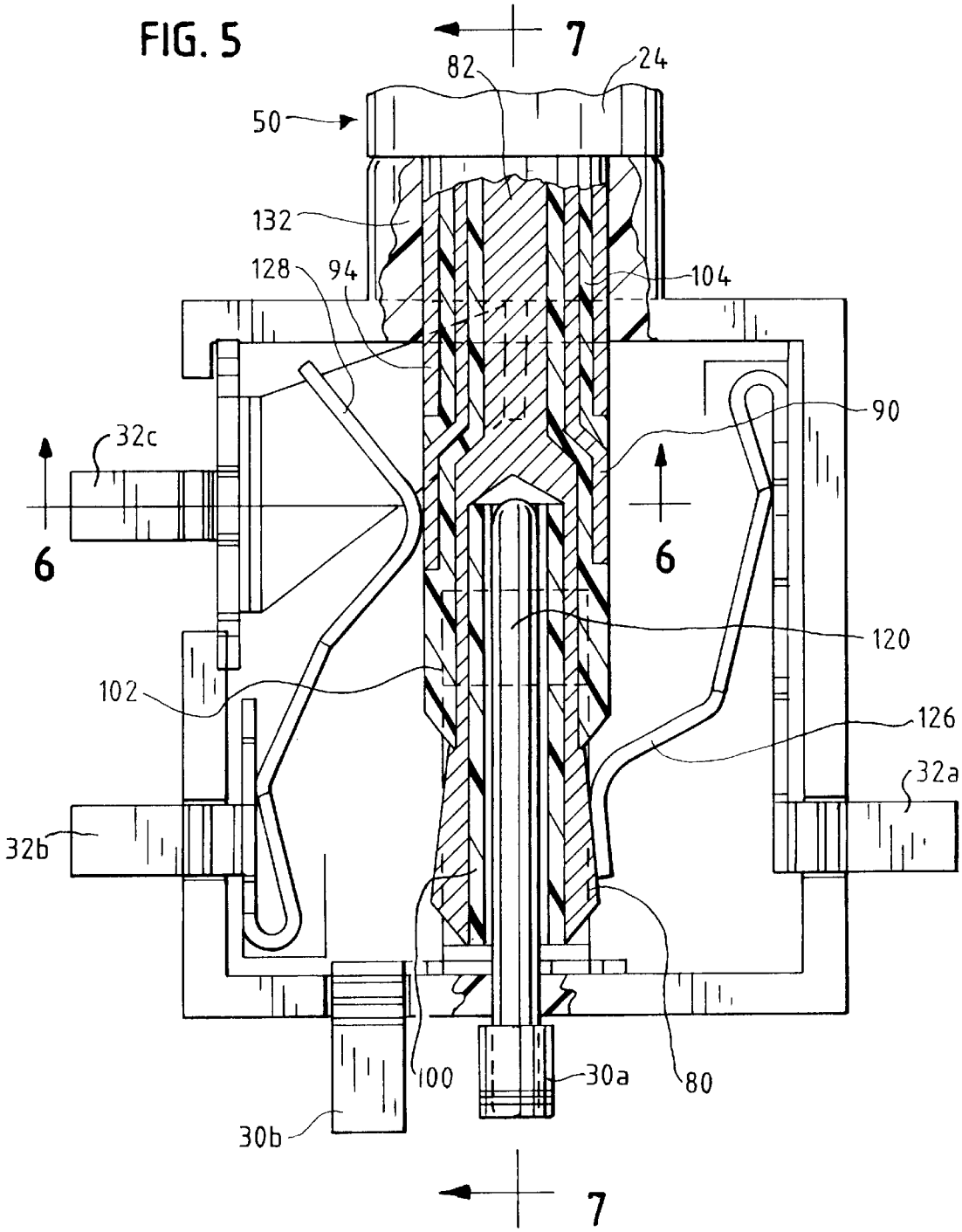
FIG. 5 is a bottom plan view of the dual-purpose jack of FIG. 4 showing the three-conductor audio plug of FIG. 3 inserted therein.
Figure 7:
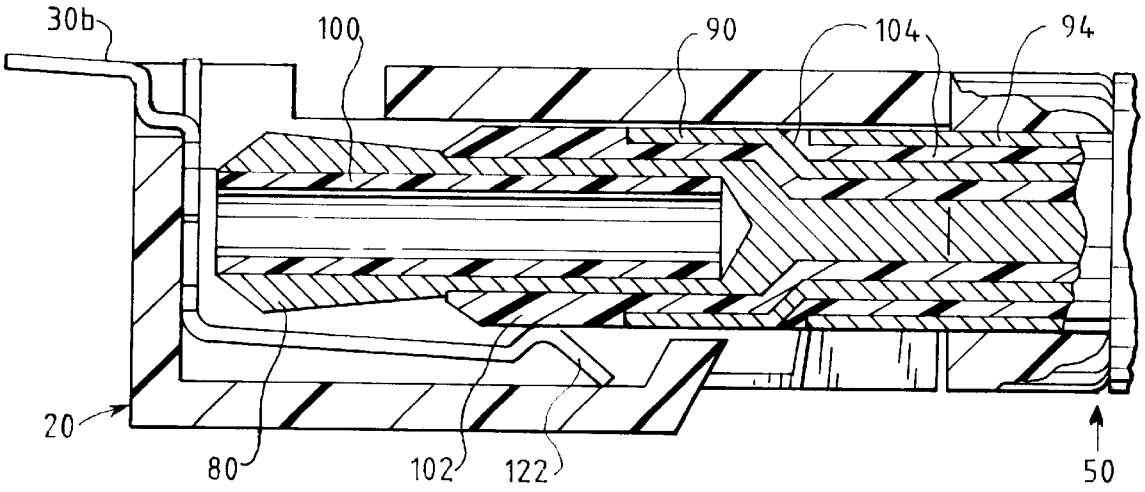
FIG. 7 is a cross-sectional view taken along lines 7—7 of FIG. 5 showing the three-conductor audio plug of FIG. 3 inserted into the dual-purpose jack.

As is seen best in FIGS. 5 and 7, a first insulated sleeve 100 is snugly inserted into the hollow interior of the metal tip 80. This sleeve 100 creates an insulated receptacle for the power pin 120 of the jack, to be described later. A second insulated sleeve 102 is spaced rearwardly from the metal tip area 80 to create an insulated band behind the conductive tip band 80. The insulated sleeve 102 then extends with reduced diameter to the rear in order to insulate the metal tip 80 from the encircling metal ring 90. A third insulated sleeve 104 is spaced rearwardly behind the metal ring 90 and creates an exterior insulated band between metal band 90 and the rearmost metal band 94. This insulated sleeve 104 then has a reduced diameter extending to the rear in order to surround and insulate the metal ring 90 and metal base 84 from the metal sleeve 94.

As will be explained below, the metal exterior rings 80, 90 and 94 of the audio pin 52 will contact the three internal contacts of the jack which connect to the audio terminals 32*a,* 32*b* and 32*c*. The insulators 100,102 and 104 serve to electrically isolate portions of the audio plug from any electrical path to the power terminals 30*a* and 30*b* when the audio plug 50 is fully inserted into the jack 20 so as to prevent interference between any power circuit and any audio circuit on the printed circuit board 22.

Figure 4:
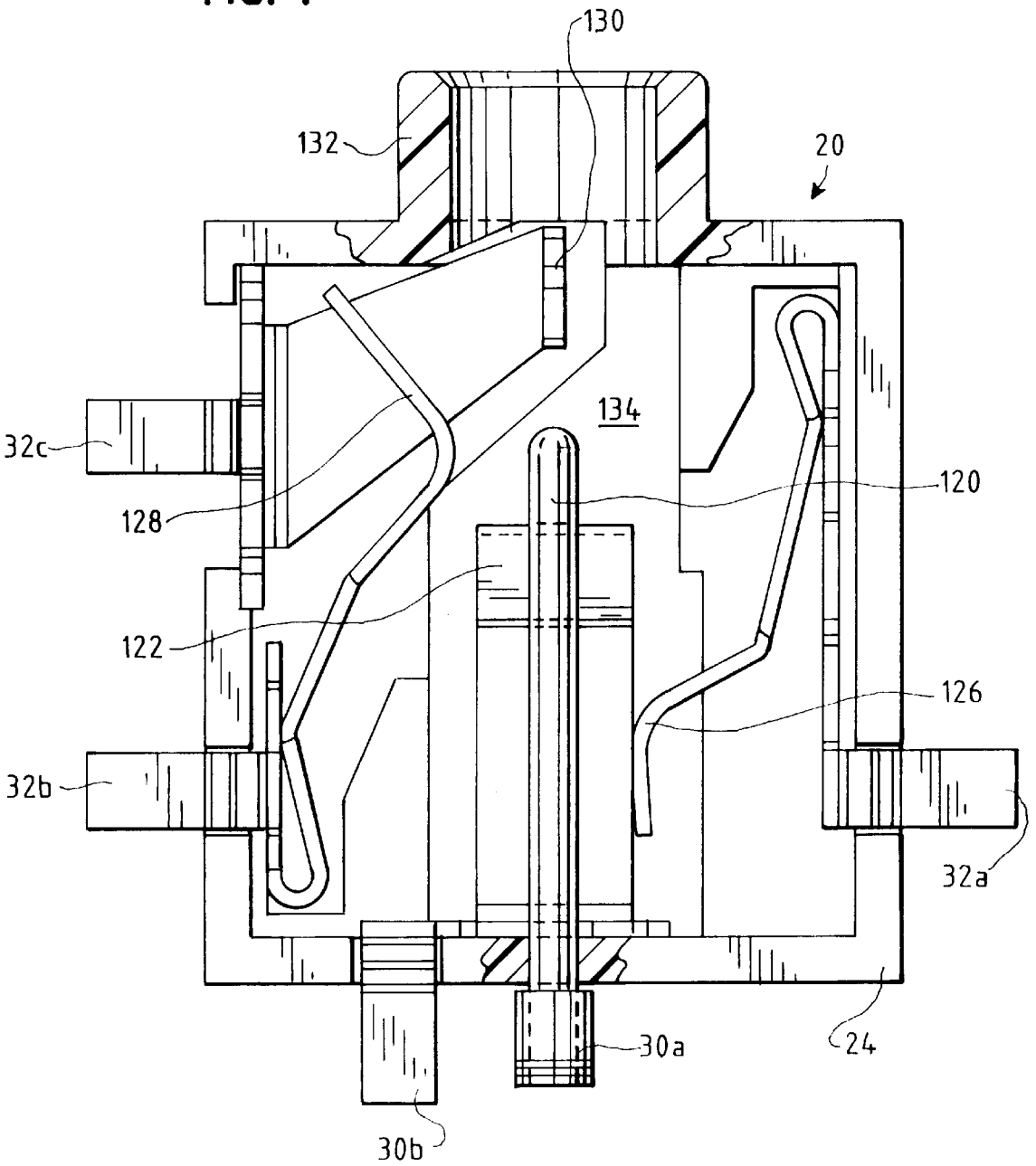
FIG. 4 is a bottom plan view of the dual-purpose jack of FIG. 1 rotated 180° and with the lower portion of its housing removed.
Figure 10:
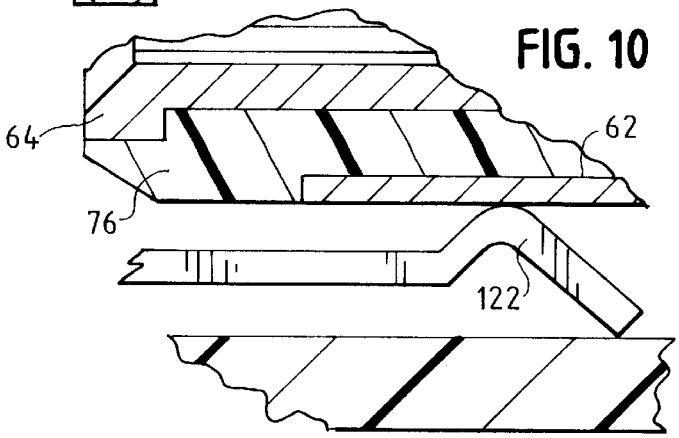
FIG. 10 is a detailed cross-sectional view taken along lines 10—10 of FIG. 8 showing the two-conductor power plug inserted in the jack.

FIG. 4 illustrates the combination jack 20 as seen from below (and flipped over with reference to FIG. 1) with the bottom of the housing removed and portions of the housing being shown in cross-section. Power terminal 30*a* connects with an elongated male pin 120 which is of standard configuration for a power pin in an electrical receptacle jack (and can be slightly compressible like a banana jack if desired). The other power terminal 30*b* is connected to a leaf spring member 122 which is located in a plane below the pin 120 and is best seen in FIG. 7 and FIG. 10. Thus, the leaf spring 122 flexes upwardly and downwardly with respect to the plane of FIG. 4 and is spaced below the pin 120, as seen best in FIG. 7.

Figure 6:
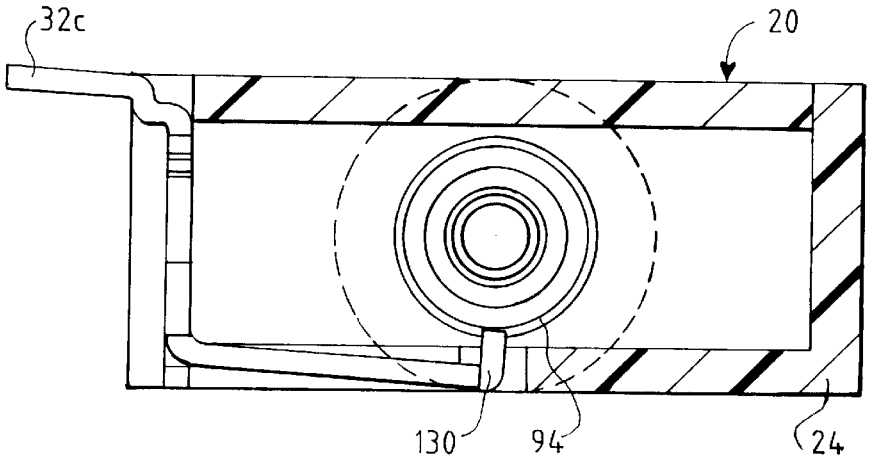
FIG. 6 is an end view of the dual-purpose jack taken along lines 6—6 of FIG. 5 and showing the three-conductor audio plug of FIG. 3 inserted therein.
Figure 9:
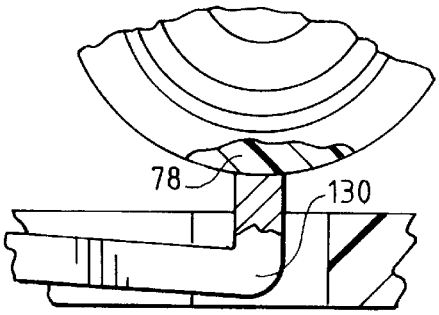
FIG. 9 is a detailed cross-sectional view taken along lines 9—9 of FIG. 8 showing the two-conductor power plug inserted in the jack.

Audio terminal 32*a* and audio terminal 32*b* are connected to leaf springs 126 and 128, respectively, as seen in FIG. 4. These pair of leaf springs 126 and 128 compress toward and away from the pin 120 as seen in the plane of FIG. 4 and this plane is at a skew to the plane of movement of the leaf spring 122, such as 90°. Audio terminal 32*c* is connected to a leaf spring 130 which is located in a different plane as best seen in FIGS. 6 and 9. Leaf spring 130 is located forwardly of the pin 120 and in a slot within a tubular bushing 132 which serves as the opening for receiving the pin 42 of the power plug 40 or the pin 52 of the audio plug 50.

In summary, the four leaf springs 122, 126, 128 and 130 are mounted for movement along three planes each normal to each other within the jack. All planes of movement intersect the longitudinal axis of the pin 120. The leaf spring 122 moves in a first plane, the leaf springs 126 and 128 move in a second plane normal to the first plane, and the leaf spring 130 moves in a third plane normal to the others. This allows the contacts for the jack to be spaced with different orientations to better accommodate a compact configuration for a miniature jack. The leaf springs, per se, are known and can take a variety of other configurations to create a bias against the surfaces of the pins 42 and 52 when inserted into the jack.

The annular bushing 132 of the plastic housing 24 serves as the circular opening for inserting the plugs into the interior receptacle area 134 of the jack. The hole size is slightly larger than 2.5 mm or 3.5 mm, for example, to receive the plug pins 42 or 52. The pin 120 is located in the middle of the receptacle area and mates with the hollow end regions of the pins of the plugs. The leaf springs 122, 126, 128 and 130 surround the generally cylindrical extent of the receptacle area 134 for contact with the exterior conductive and/or insulating bands formed on the exterior surfaces of the pins 42 and 52 when inserted fully into the jack 20.

Figure 8:
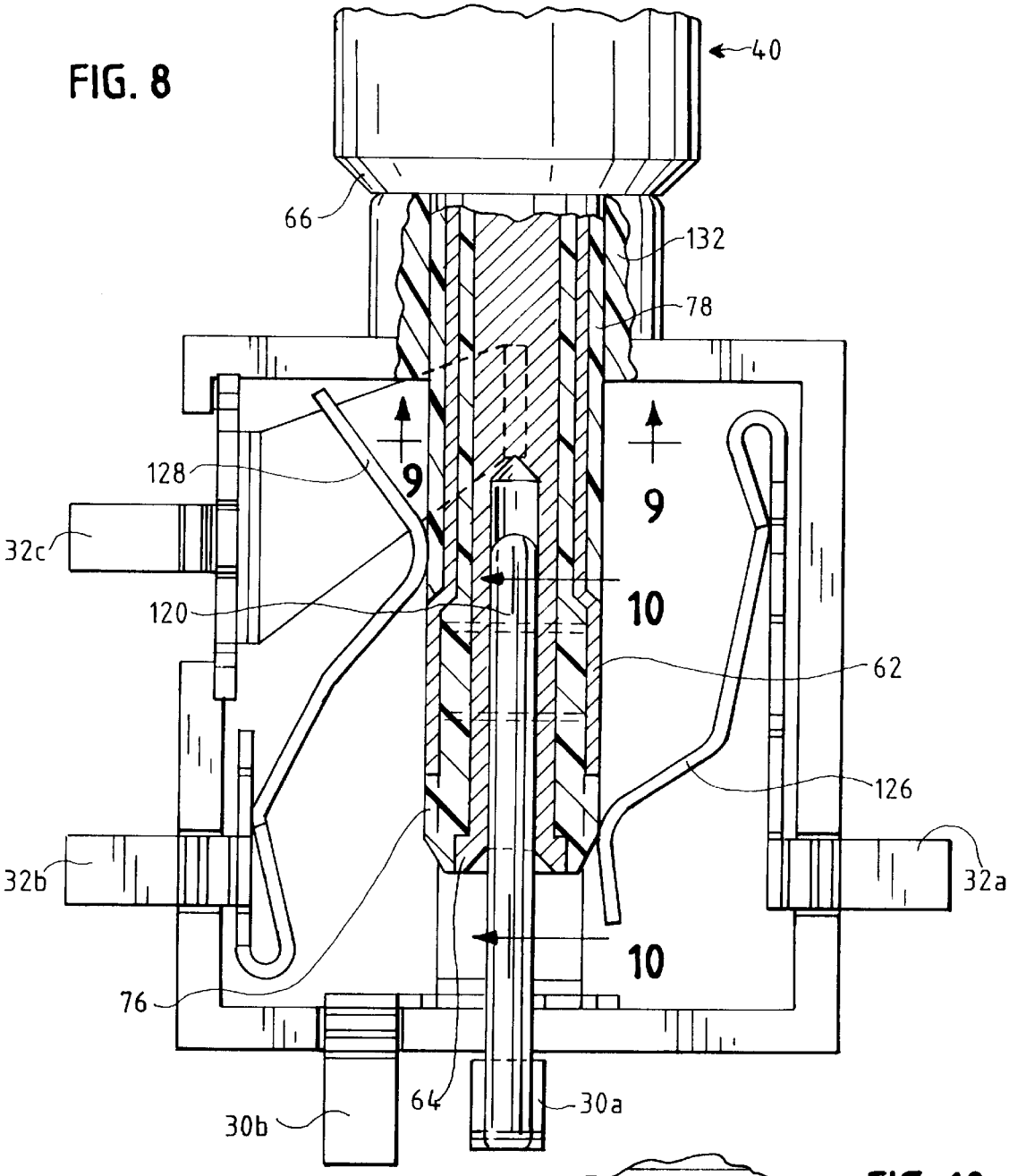
FIG. 8 is a bottom plan view of the dual-purpose jack of FIG. 4 showing the two-conductor power plug of FIG. 2 inserted therein.

The relationship between the connectors inside the combination jack 20 and each of the two different plugs 40 and 50 are shown in the remaining FIGS. 5 through 10. FIGS. 5–7 illustrate the combination jack 20 with the audio plug 50 inserted therein. FIGS. 8–10 illustrate the power plug 40 inserted into the jack.

Turning first to FIGS. 5–7, the audio pin 52 is seen as inserted fully into the jack 20. The audio terminal 32*a* and its connected leaf spring 126 makes contact with the audio tip area 80; the audio terminal 32*b* and its connected leaf spring 128 makes contact with the ring terminal area 90; and the audio terminal 32*c* and its connected leaf spring 130 makes contact with the sleeve terminal 94. Thus, the three audio terminals 32*a*, 32*b* and 32*c* are biased into engagement with the three audio contact areas of the audio jack 50. At this time, the power pin 120 is located within the inner insulator sleeve 100 and hence the power terminal 30*a* has no electrical contact with and is isolated from the power plug 50 (see FIG. 5). Similarly, the power leaf spring 122 is located against the middle ring insulator band 102 and hence the power terminal 30*b* is also electrically disconnected from the active conductors of the audio plug 50.

FIGS. 8–10 illustrate the combination jack 20 with the power plug 40 being inserted therein. It should be noted that the overall length of the pin 42 is less than the overall length of the pin 52 of the audio plug 50 (compare FIG. 8 with FIG. 5). Hence, the power pin 42 engages the internal contacts of the combination jack at different locations than was the case when the audio plug had been inserted in the jack. When the power plug is inserted, the metal pin 120 snugly engages the hollow metal inner tube 64 and thereby electrically connects the power terminal 30*a* to inner tube 64 and thus to the pin terminal 68 seen in FIG. 2. The other power terminal 30*b* is connected to leaf spring 122 which, as seen best in FIG. 10, is biased into engagement with the metal outer sleeve 62 which serves as the other power contact for the power plug. In contrast, the audio terminal 32*a* and its leaf spring 126, the audio terminal 32*b* and its leaf spring 128, and the audio terminal 32*c* and its leaf spring 130, are all biased in engagement with insulated exterior ring portions of the power pin 42. Thus, the audio circuitry of the printed circuit board is electrically isolated from the power circuitry when the power plug is inserted into the combination jack.

The invention thus provides an electrical connector system in which a single jack can accommodate various types of different plugs for connecting power, audio and/or other signals. Although the preferred embodiment has illustrated a two-conductor power plug and a three-conductor audio plug, it is not necessary that the invention be limited to power and audio use nor these particular number of conductors. Numerous variations can be made without departing from the invention. Such variations will be apparent to one of ordinary skill in the art.

What is claimed is:

1. An electrical connector system comprising a first plug having a first protecting pin with a first set of electrical contacts, the first plug having two electrical contacts for a power connection, a second plus having a second projecting pin with a second set of electrical contacts, at least certain of the second set of electrical contacts being different than the first set of electrical contacts, the second plug having at least three electrical contacts for an audio connection, and a dual purpose jack having electrical connectors corresponding to the first and second sets of electrical contacts and adapted to receive the first projecting pin or alternatively the second projecting pin, the dual purpose jack having at least five electrical connectors with two of said connectors mating with the two electrical contacts of the first plug and three of said connectors mating with the electrical contacts of the second plug while being electrically isolated from the two electrical contacts for the power connection, whereby a single jack is adapted to mate with different types of plugs.

2.The electrical connector system of claim 1 wherein the first projecting pin is hollow and includes an inner annular contact for connection to power, the second projecting pin having a plurality of exterior annular surfaces spaced along the pin to form the electrical contacts for audio, and the dual purpose jack has a jack projecting pin insertable within the hollow interior of the first projecting pin for connection to power and a plurality of members movable into engagement with the external annular surfaces for connection with audio.

3. The electrical connector system of claim 2 wherein the jack includes an additional member movable into contact with the first projecting pin to create a second electrical contact for power.

4. An electrical connector system comprising:

a power plug having a projecting pin which is hollow and defines an inner annular surface forming one contact for power, and having a second electrical contact for power, a signal plug having a projecting pin which contains a plurality of exterior annular surfaces spaced along the pin to form a plurality of contacts for signals, the protecting pin of the signal plug being hollow, the signal plug having at least three contacts for audio signals, a combination jack having a receptacle for mating engagement with the projecting pin of the power plug and the protecting pin of the signal plug, said jack having an elongated metal pin insertable within the hollow projecting pin of each plug when inserted in the receptacle, the elongated metal pin being connected to an external power terminal, said lack further having a plurality of spring members for mating engagement with the protecting pin of each plug when inserted in the receptacle and aligned with the plurality of exterior annular surfaces associated with the signal plug, the plurality of spring members being connected to a corresponding plurality of external signal terminals, said jack having a metal member biased in engagement with the second electrical contact when the power plug is inserted in the receptacle and a second external power terminal coupled to the metal member, and the combination jack has at least five external terminals with three of said terminals being coupled to the spring members to thereby electrically couple to the contacts of the audio signal plug while being electrically isolated from the power terminals.

* * * * *

UNITED STATES PATENT AND TRADEMARK OFFICE

CERTIFICATE OF CORRECTION

PATENT NO. : 6,126,465
DATED : October 3, 2000
INVENTOR(S) : George J. Franks, Jr.

It is certified that error appears in the above-identified patent and that said Letters Patent is hereby corrected as shown below:

Column 6, line 39, delete "plus" and insert –plug--

Column 6, line 36, delete "protecting" and insert –projecting--
(Amendment A page 2, line 4)

Column 8, line 2, delete "lack" and insert –jack--
(Amendment A page 3, line 14)

Column 8, line 4, delete "protecting" and insert –projecting--
(Amendment A page 3, line 15.

Signed and Sealed this

Eighth Day of May, 2001

*Attest:*

Nicholas P. Godici

NICHOLAS P. GODICI

*Attesting Officer*

*Acting Director of the United States Patent and Trademark Office*